US011187484B2

(12) United States Patent
Hartwell

(10) Patent No.: US 11,187,484 B2
(45) Date of Patent: Nov. 30, 2021

(54) FIREARMS SUPPRESSOR ASSEMBLY

(71) Applicant: George Nicholas Hartwell, Chesapeake Beach, MD (US)

(72) Inventor: George Nicholas Hartwell, Chesapeake Beach, MD (US)

( * ) Notice: Subject to any disclaimer, the term of this patent is extended or adjusted under 35 U.S.C. 154(b) by 0 days.

(21) Appl. No.: 15/920,366

(22) Filed: Mar. 13, 2018

(65) Prior Publication Data

US 2019/0285375 A1 Sep. 19, 2019

(51) Int. Cl.
*F41A 21/30* (2006.01)

(52) U.S. Cl.
CPC ..... *F41A 21/30* (2013.01)

(58) Field of Classification Search
CPC ..... F41A 21/26; F41A 21/28; F41A 21/325; F41A 21/30
USPC ..... 89/14.1–14.4
See application file for complete search history.

(56) References Cited

U.S. PATENT DOCUMENTS 4,291,610 A * 9/1981 Waiser ..... F41A 21/30 89/14.4
8,844,422 B1 * 9/2014 Klett ..... F41A 21/30 89/14.2
9,080,829 B1 * 7/2015 Cellini ..... F41A 21/34
9,500,427 B1 * 11/2016 Larue ..... F41A 21/30
9,746,267 B2 * 8/2017 Smith ..... F41A 21/30
10,393,463 B1 * 8/2019 Sanders ..... F41A 21/325
10,533,819 B2 * 1/2020 Thomas ..... F41A 21/30
2011/0088540 A1 * 4/2011 Brittingham ..... F41A 21/30 89/14.5
2012/0167749 A1 * 7/2012 Young ..... F41A 21/30 89/14.3
2015/0001001 A1 * 1/2015 Wilson ..... F41A 21/30 181/223
2015/0260472 A1 * 9/2015 Smith ..... F41A 21/30 89/14.2
2016/0123689 A1 * 5/2016 Maeda ..... F41A 21/36 89/14.3
2017/0205175 A1 * 7/2017 Garst ..... F41A 21/30

* cited by examiner

*Primary Examiner* — John Cooper

(57) ABSTRACT

A firearms suppressor assembly is disclosed. The firearms suppressor assembly includes a blast chamber for receiving a bullet and a gas discharge from a fired round. The firearms suppressor has at least one machine rail receiver to removably couple with the at least one machine rail of the barrel when the suppressor is mounted on the barrel. The firearms suppressor also has at least one suppressor muzzle brake port opening through a first internal wall of the suppressor. The firearms suppressor having a longitudinal baffle having a multiple leg longitudinal run about the outermost periphery of the suppressor, the longitudinal baffle receiving a portion of the gas discharge from the at least one suppressor muzzle brake port and direct it toward a plurality of expulsion ports at a front of the suppressor.

18 Claims, 7 Drawing Sheets

500

FIREARMS SUPPRESSOR ASSEMBLY

TECHNICAL FIELD

Examples described herein relate to a firearms suppressor assembly often used for reducing the sound emanating from a gun barrel during the firing of a projectile.

BACKGROUND

Firearms suppressors are utilized to reduce sound emanating from a barrel of a fired weapon. They are usually either welded onto a barrel or screwed into place. In many areas of the world, the use of suppressors is important to reduce noise pollution, hearing damage, and the like.

BRIEF DESCRIPTION OF THE DRAWINGS

The accompanying drawings, which are incorporated in and form a part of this specification, illustrate various embodiments and, together with the Description of Embodiments, serve to explain principles discussed below. The drawings referred to in this brief description should not be understood as being drawn to scale unless specifically noted.

DETAILED DESCRIPTION

Reference will now be made in detail to embodiments of the subject matter, examples of which are illustrated in the accompanying drawings. While the subject matter discussed herein will be described in conjunction with various embodiments, it will be understood that they are not intended to limit the subject matter to these embodiments. On the contrary, the presented embodiments are intended to cover alternatives, modifications and equivalents, which may be included within the spirit and scope of the various embodiments as defined by the appended claims. Furthermore, in the Description, numerous specific details are set forth in order to provide a thorough understanding of embodiments of the present subject matter. However, embodiments may be practiced without these specific details. In other instances, well known methods, procedures, components, and circuits have not been described in detail as not to unnecessarily obscure aspects of the described embodiments.

In the following discussion, a number of different views of the parts and components are shown in the firearms suppressor assembly. Although a number of parts and components are discussed herein, it should be appreciated that different embodiments may include different parts, equivalent parts, replacement parts, different parts groupings, a combination of parts into a single part, dissemination of a single part into a plurality of parts, and the like. Moreover, although illustrative embodiments have been described in detail herein with reference to the accompanying drawings, variations to specific embodiments and details are encompassed by this disclosure. It is intended that the scope of embodiments described herein be defined by claims and their equivalents.

Barrel

Figure 1:
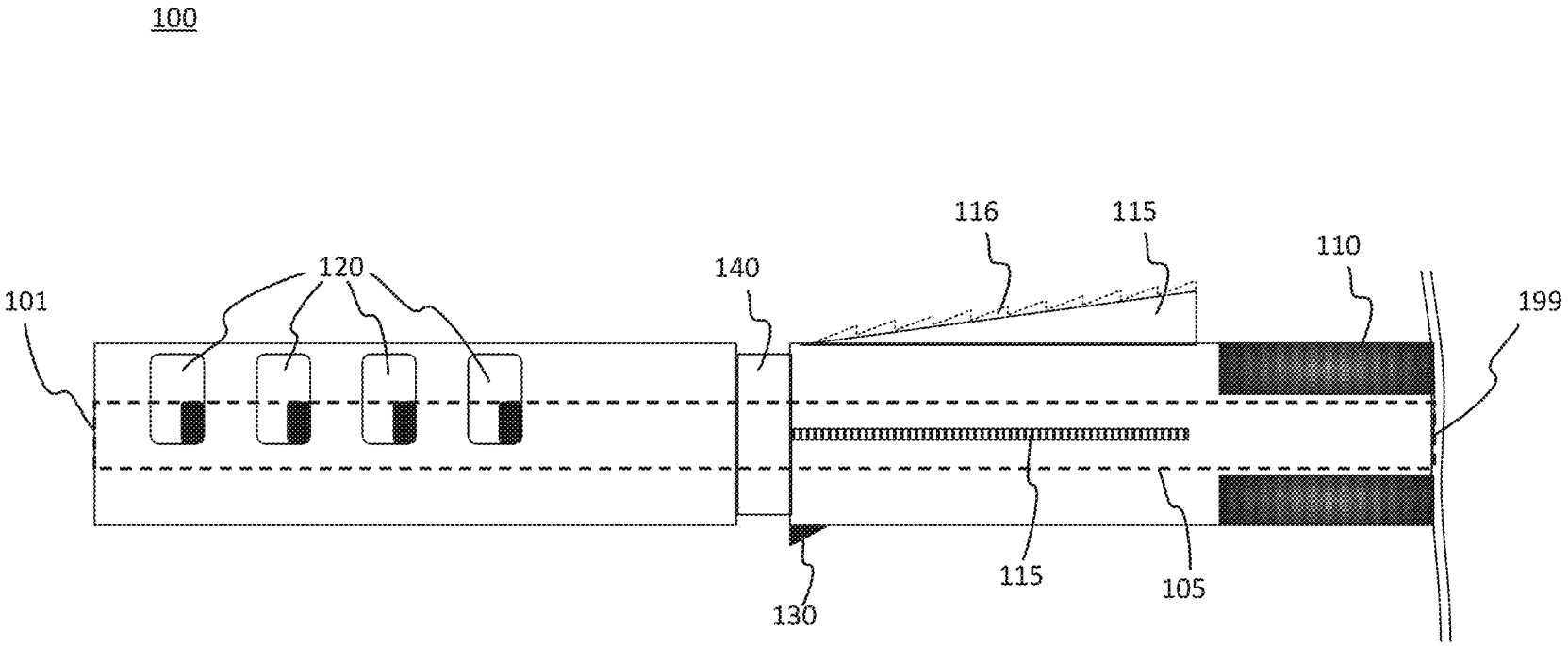
FIG. 1 is a side view of the muzzle end of a firearm barrel, in accordance with an embodiment.

With reference now to FIG. 1, a side view of the muzzle end of a firearm barrel 100 (or barrel assembly) is shown in accordance with an embodiment. In one embodiment, barrel 100 is a carbon fiber 110 wrapped design. Barrel 100 has a front end 101, e.g., a discharge end, a projectile discharge end, etc. That is, the end from which the fired projectile will exit. Barrel 100 also has a rear end 199, e.g., the end which attaches to the weapon chamber a point from which the projectile will begin traveling down barrel 100 after it has been ejected from the casing.

Barrel 100 includes a bore 105, and at least one barrel muzzle brake port 120 at a muzzle end 101 of barrel 100, at least one machined rail 115 behind the barrel muzzle brake port 120, and a barrel gasket channel 140 between the at least one integrated muzzle brake port 120 and the at least one machine rail 115 of barrel 100. Barrel 100 may optionally include an alignment and caliber designating bore tab 130 coupled to the barrel. In one embodiment, machined rail 115 includes teeth 116 for providing coupling capabilities. Although teeth are shown, other methods of coupling may be used by machined rail 115.

In one embodiment, barrel muzzle brake port 120 opens through a radial portion of the barrel end assembly. That is, it passes through only one side of the cylindrical barrel, and not completely through both sides of the barrel. Barrel muzzle brake port 120 has a forward angle orientation and opens completely through a portion of the barrel from the bore outward. The forward angle orientation allows the gas discharge from a fired round to exit the barrel through the barrel muzzle brake port 120 while continuing toward the muzzle. In one embodiment, the barrel rnuzzle brake ports are located equally on either side of barrel 100 for stability while the firearm is fired. In one embodiment, the barrel muzzle brake ports 120 may be provided above the center line of barrel 100 to provide for reduced rise during recoil. In one embodiment, there is more than one barrel muzzle brake port 120. However, although four ports are shown in FIG. 1, that number is also exemplary. The specific angle of said ports may be different based on optimized gas flow of different calibers. It should be appreciated that embodiments may have more or fewer and larger or smaller and different angles of ports. The use of four in the illustrations is for purposes of clarity.

At least one toothed, machined rail 115 is astern of the at least one integrated muzzle brake port 120. In one embodiment a plurality of toothed, machined rails are used both for suppressor retention and for suppressor barrel orientation purposes as will be described in further detail in the discussion of FIGS. 3 and 4A-4B. In one embodiment, the integrated barrel end assembly including the at least one machined rail 115 is integrally formed with (e.g., formed as part of) the barrel during a barrel machining process. For example, using a computer numerical controlled machine during the barrel manufacturing process.

In another embodiment, a separate barrel end assembly is manufactured including at least one integrated barrel muzzle end attachment rails 115, at least one muzzle brake port 120, barrel gasket channel 140 and an indexing and caliber designating bore tab 130 is attached (e.g., coupled) to the discharge end of the barrel using a coupling system from the group of attachment methods, such as e.g., threaded, pinned, welded or clamped.

Suppressor

Figure 2:
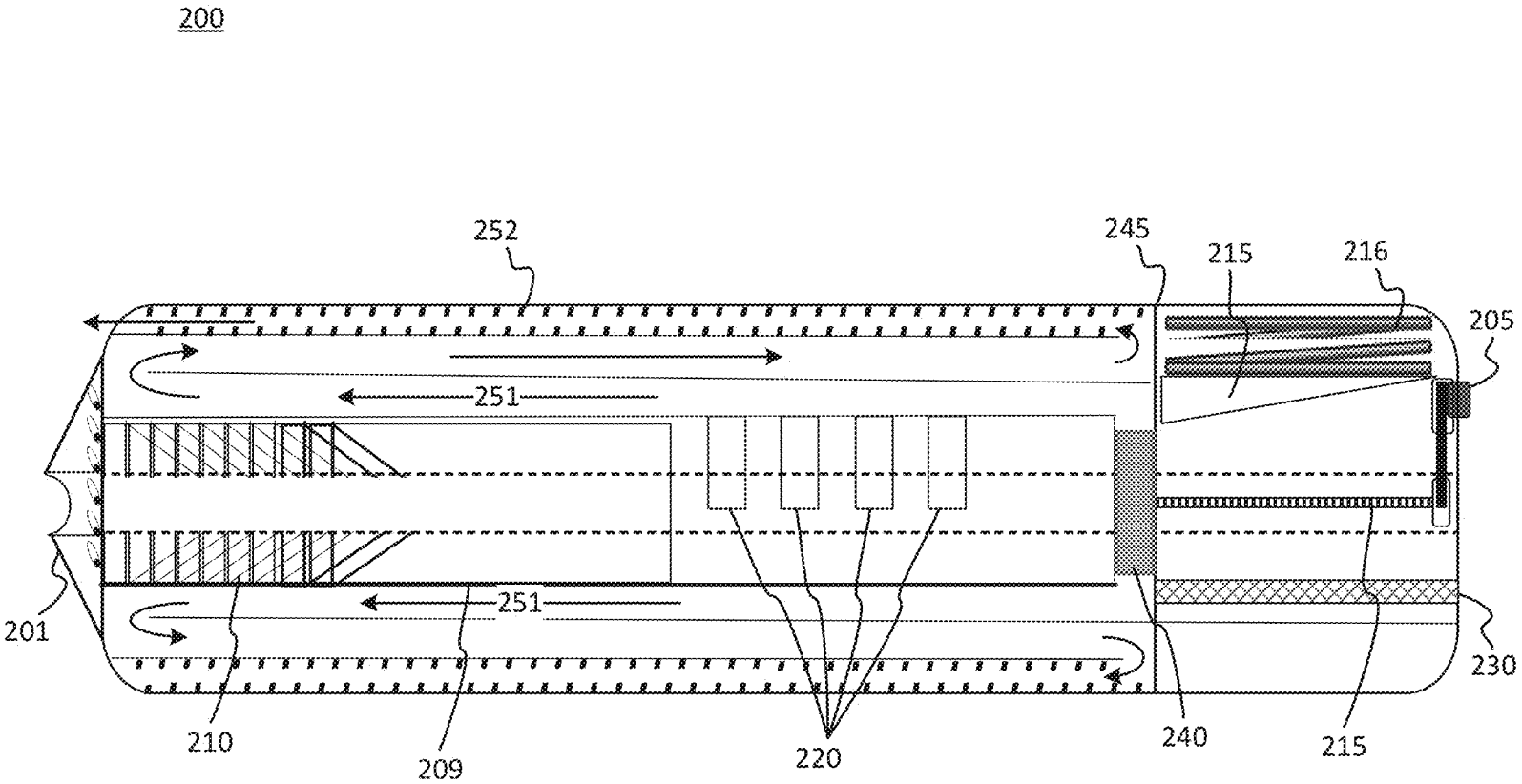
FIG. 2 is a cutaway side view of a firearm suppressor and its components, in accordance with an embodiment.

Referring now to FIG. 2, a cutaway side view of a firearm suppressor assembly and its components is shown in accordance with an embodiment. Embodiments described herein incorporate multiple signature reduction technologies while increasing the efficient performance of the firearms suppressor. Suppressor assembly 200 has a forward end 201, e.g., the same end from which the fired projectile will be exiting the barrel. Suppressor assembly 200 is removably coupled with barrel 100 and includes a blast chamber 209 for receiving a bullet and a gas discharge from a fired round, an indexed baffle stack 210, at least one toothed, machined rail receiver 215, at least one suppressor muzzle brake port 220, a suppressor gasket channel 240, a longitudinal baffle 251, and an optional indexing and caliber designating channel 230.

Indexed baffle stack 210 arranged circumferentially about blast chamber 209 of suppressor assembly 200. In one embodiment, the baffle stack 210 may be an indexed baffle stack. In one embodiment, baffle stack 210 includes a titanium linear cone design for sound reduction. In one embodiment, baffle stack 210 includes an Inconel initial 1-2 blast baffle to reduce or eliminate sparking normally experienced with full titanium baffle stacks. In one embodiment, baffle stack 210 is removable for different design baffles, includes monocore inserts optimized for specific calibers, or the like. As such, the design allows for several different options for optimizing baffles for different caliber rounds, from fixed baffles to modifiable baffles made of several different materials.

Figure 4A:
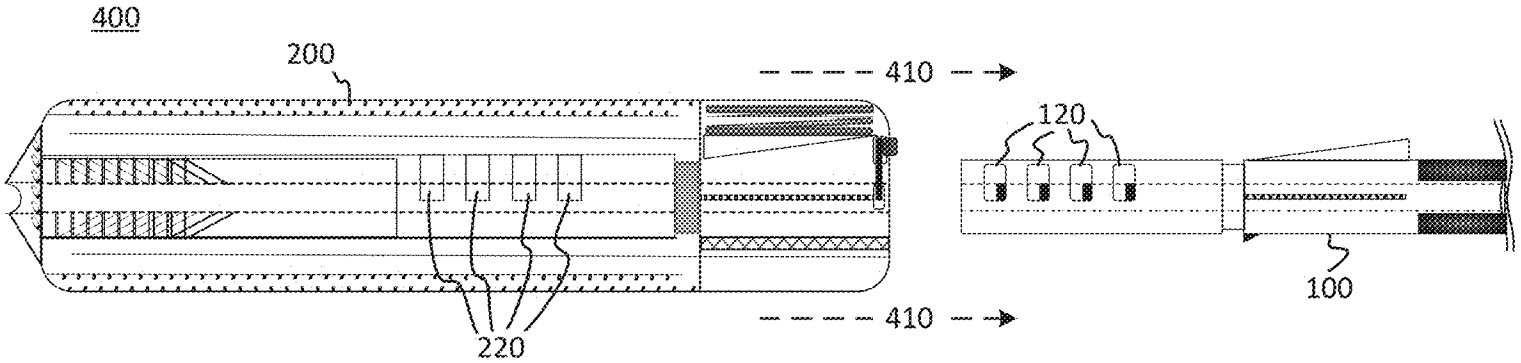
FIG. 4A is cutaway side view of the suppressor preparing to couple with the barrel, in accordance with an embodiment.
Figure 4B:
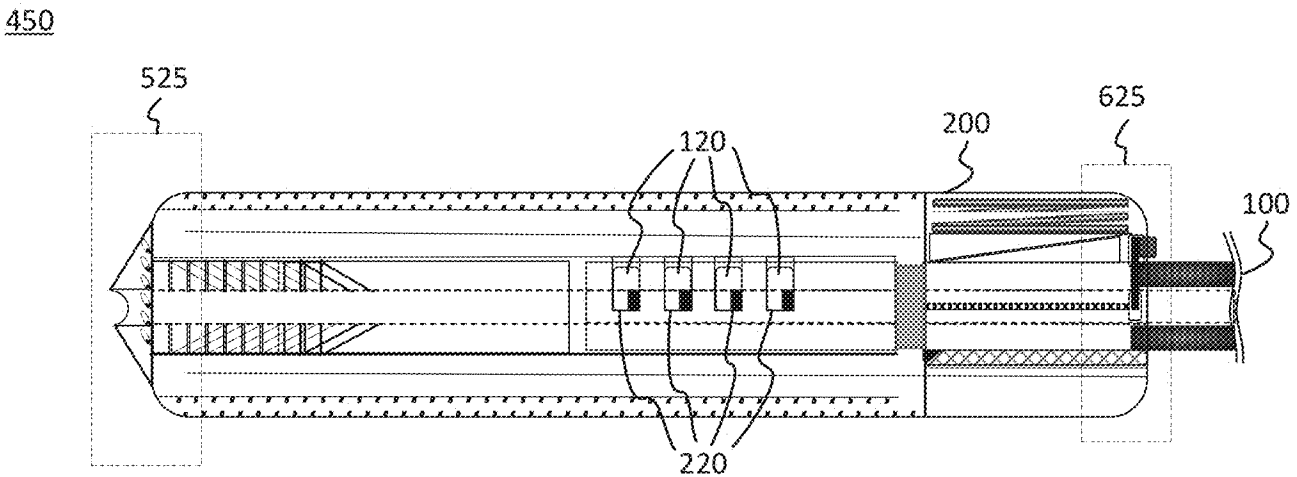
FIG. 4B is cutaway side view of the suppressor coupled with the barrel, in accordance with an embodiment.

At least one toothed, machined rail receiver 215 is located at a distal end of suppressor assembly 200, and is removably coupled with the at least one toothed, machined rail 115 of the barrel when suppressor assembly 200 is mounted on barrel 100 as shown in more detail in FIG. 4B. In one embodiment, the at least one toothed, machined rail has a first plurality of teeth and the at least one machined rail receiver has a second plurality of teeth coupled with a spring 216. In one embodiment, spring 216 provides inward pressure on the second plurality of the teeth of the machine rail receiver 215 such that the first plurality of teeth engages with the second plurality of teeth when suppressor assembly 200 is mounted on the barrel. For example, the teeth will act as a ratcheting mechanism to help guide suppressor assembly 200 into full and complete joinder with barrel 100.

Although a number of toothed, machined rail(s) 115 and toothed, machined rail receiver(s) 215 are shown, the actual number of tooted, machined rail(s) 115 and toothed, machined rail receiver(s) 215 may be different. In one embodiment, as discussed in detail herein, the number and orientation of toothed, machined rail(s) 115 and toothed, machined rail receiver(s) 215 are determined such that suppressor assembly 200 can securely fit only in a single orientation with respect to barrel 100.

In one embodiment, a gasket fits into the suppressor gasket channel 240 and the barrel gasket channel 140 to seal the portion of the suppressor to the rear of the suppressor gasket channel 240 from the gas discharge moving through the portion of the suppressor to the front of the suppressor gasket channel 240.

The at least one suppressor muzzle brake port 220 opening is through a first internal wall of suppressor assembly 200 and is designed to align with the at least one barrel muzzle brake port 120 when suppressor assembly 200 is mounted on barrel 100. In general, the vertically aligned, forward angled integrated muzzle brake 120/220 design vectors expelled gasses through matching internal port 220 in suppressor assembly 200 and into longitudinal baffle 251 will reduce muzzle rise.

Longitudinal baffle 251 receives a portion of the gas discharge from the at least one suppressor muzzle brake port 220. In one embodiment, longitudinal baffle 251 includes at least a three leg longitudinal run about the outermost periphery of suppressor assembly 200. The first leg has openings to receive the gas discharge from the at least one suppressor muzzle brake port 220 and direct it toward a front of suppressor assembly 200. The second leg of the run is parallel to, but in an outer more position than the first leg. The second leg receives the gas discharge from the first leg at the front of suppressor assembly 200 and directs it toward a back of suppressor assembly 200, The third, or outermost leg receives the gas discharge from at least the second leg at the rear of suppressor assembly 200 (e.g., by isolator 245) and directs it toward the plurality of expulsion ports 610 at the front of suppressor assembly 200.

In other words, by combining the increased volume provided by longitudinal baffle 251 with the full length and circumferential design, the increased internal dwell time of the hot gasses allows for both increased expansion and cooling of the hot discharge gasses, thus decreasing both audible signature of the fired round and reduced weapon bolt cyclic rate. In one embodiment, longitudinal baffle 251 triples a travel distance of the gasses resulting in increased cooling efficiency (similar to the effects of a longer suppressor).

In one embodiment, wall thickness of tubular longitudinal baffles 251 decreases from inner to outer, reducing weight. In other words, the wall thickness of the third leg is less than the wall thickness of the second leg, and the wall thickness of the second leg is less than the wall thickness of the first leg.

Figure 6:
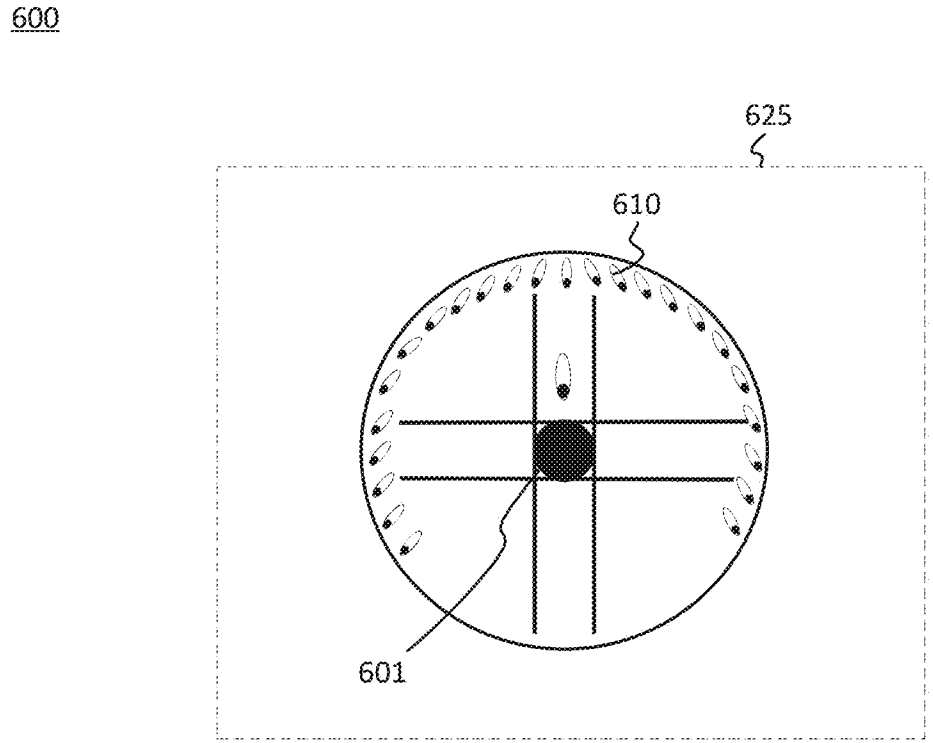
FIG. 6 is a front view of the muzzle end of the firearms suppressor, in accordance with an embodiment.

Outer run of longitudinal baffle has directional vanes 252 to impart optimized directional flow, further reduce gas speed, and direct the gasses to expulsion ports 610 which are shown in detail of FIG. 6. In one embodiment, the directional vanes 252 are spiral. In one embodiment, the pluralities of directional vanes 252 run along an inner wall. In another embodiment, the pluralities of directional vanes 252 run along an outer wall. In yet another embodiment, the pluralities of directional vanes 252 run along both the inner wall and the outer wall.

Indexing and caliber designating channel 230 is a channel within suppressor assembly 200, into which the indexing and caliber designating bore tab 130 is configured to slide down when suppressor assembly 200 is placed on barrel 100.

Figure 3:
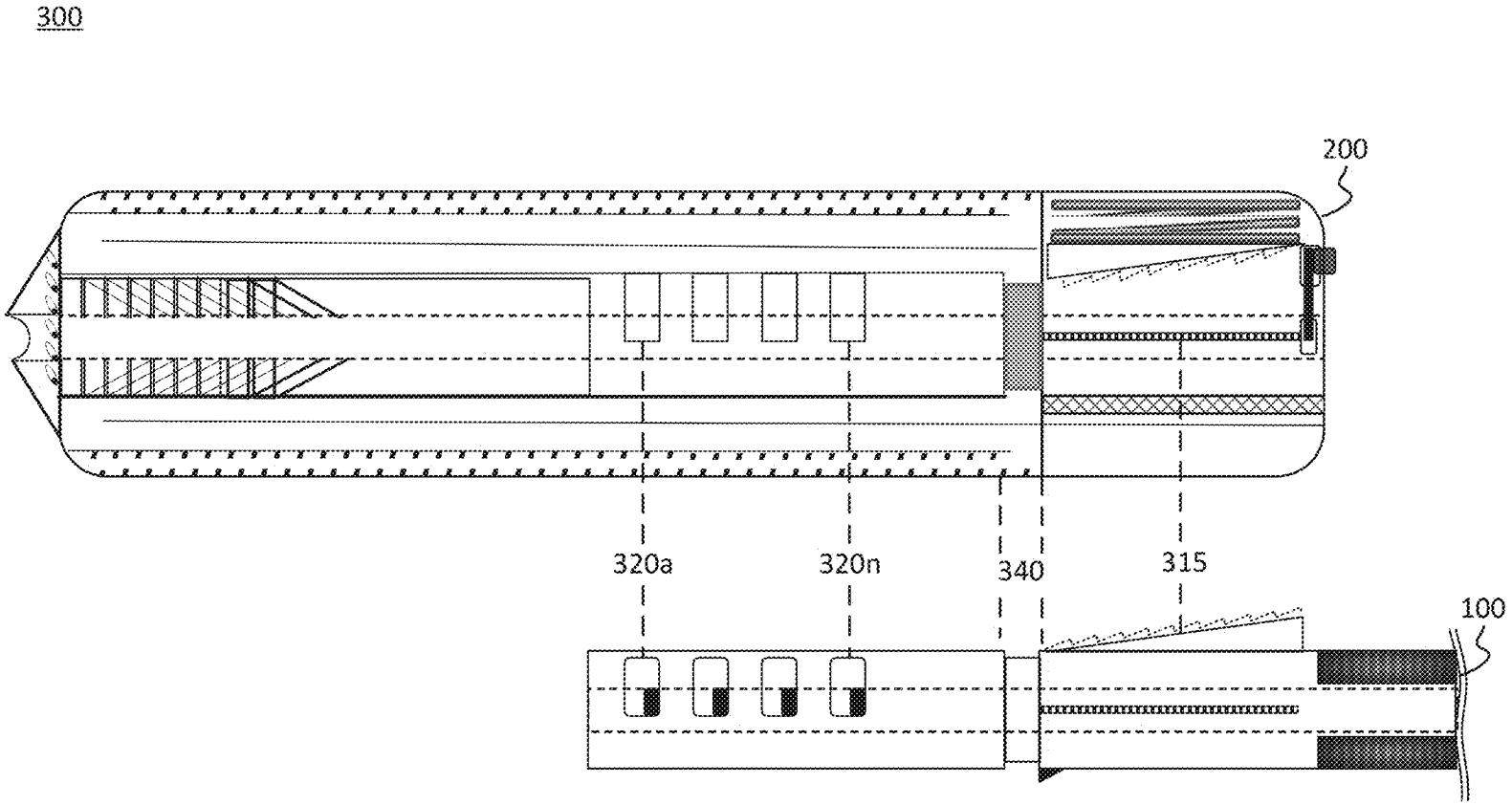
FIG. 3 is a cutaway side view illustrating the alignment between the barrel and the suppressor, in accordance with an embodiment.

With reference now to FIG. 3, a cuutaway side view illustrating the alignment between the barrel and the suppressor is shown in accordance with an embodiment. The reflex design of suppressor assembly 200 over barrel 100 allows for significant increase in internal volume of suppressor assembly 200 without significantly increasing overall length of weapon with suppressor assembly 200 attached.

Alignment 315 illustrates the alignment between the toothed machined rail receiver 215 and the toothed machined rail 115. Alignment 320*a*-320*n* illustrates the alignment between suppressor muzzle brake port 220 and barrel muzzle brake port 120. Alignment 340 illustrates the alignment between suppressor gasket channel 240 and barrel gasket channel 140.

Referring now to FIG. 4A, cutaway side view of suppressor assembly 200 preparing to couple with barrel 100, via suppressor assembly 200 moving in direction 410, is shown in accordance with an embodiment. As shown in FIG. 4A, the linear aligned, indexed (only goes on one way) toothed machined rails 115 and optionalindexing and caliber designating bore tab 130 on bottom. Toothed machined rails 115 allow for quick detach connection internal to rear of suppressor body.

In other words, since the machined rails 115 only allow suppressor assembly 200 to be installed in a single orientation, the proper orientation of suppressor assembly 200 with respect to barrel 100 is ensured thereby eliminating the variable of indexing issues that cause point of impact shift. E.g., suppressor assembly 200 can only go on one way and the orientation between suppressor assembly 200 and barrel 100 is fixed even if suppressor assembly 200 is removed and then reattached. Further, a tight tolerance between machined rail receiver 215 toothed valleys to barrel 100 toothed machined rails 115 eliminates rotational movement of suppressor assembly 200.

Indexing and caliber designating bore tab 130 is used to ensure the proper suppressor is fitted to the appropriate caliber weapon and may be used in conjunction with indexing and caliber designating channel 230 to ensure proper orientation of suppressor assembly 200 with respect to barrel 100.

Indexing and caliber designating bore tab 130 and indexing and caliber designating channel 230 are also designed to ensure that the right suppressor size only fits on the appropriate caliber gun. For example, the barrel 100 suppressor assembly 200 design allows for standardized barrel muzzle brake diameter which means the standard suppressor assembly 200 designs can be utilized across a plethora of caliber sizes. In so doing, one embodiment allows for interchangeability of larger caliber suppressors on smaller caliber rifles if needed (i.e.: 0.300 WM or 0.308 suppressor on a 5.56 mm rifle). However, because of the difference in bore diameter, the interchangeability should only be in one direction, e.g., from large caliber suppressor assembly 200 to smaller caliber weapons and not vice-versa.

By ensuring that indexing and caliber designating bore tab 130 on a large caliber weapon is larger than indexing and caliber designating bore tab 130 on a smaller caliber weapon; and by making the indexing and caliber designating channel 230 width in relation to the size of the indexing and caliber designating bore tab 130 per caliber. The indexing and caliber designating bore tab 130 to indexing and caliber designating channel 230 relationships will ensure that a smaller caliber suppressor assembly 200 cannot be accidentally placed onto a larger caliber rifles. Moreover, in one embodiment, this may be further addressed by removing the indexing and caliber designating channel 230 internal to the suppressor asset bly 200 on the smallest caliber suppressor assembly 200.

With reference now to FIG. 4B, cutaway side view of the suppressor coupled with the barrel is shown in accordance with an embodiment. As shown in FIG. 4B, the muzzle brake port design in barrel 100 vectors expelled gasses through matching internal ports in suppressor assembly 200 and into longitudinal baffle 251. Using the muzzle brake ports 120 and 220 will reduce muzzle rise as the directed gas will provide a down force as it impacts with the outside wall of suppressor assembly 200.

Figure 5:
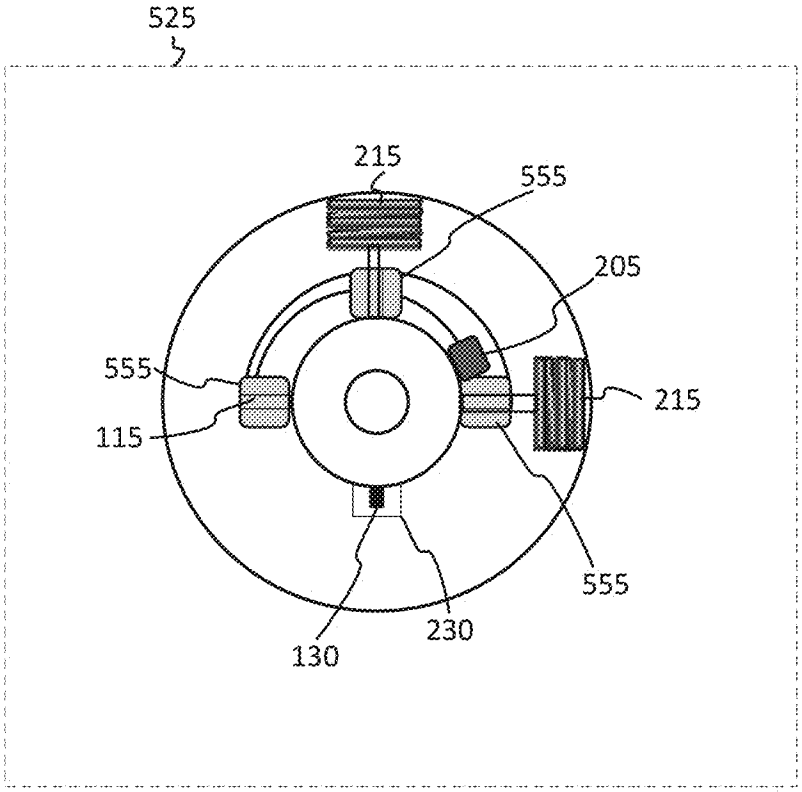
FIG. 5 is a cutaway view of the barrel housing end of the firearms suppressor, in accordance with an embodiment.

With reference now to FIG. 5, a cutaway view 525 of the barrel housing end of the firearms suppressor is shown in accordance with an embodiment. A linear othed Quick Detach (QD) with shielded release button 205 is provided on a top rear of suppressor assembly 200. Although a release button 205 is shown, the release could be a lever, tab, and the like. The QD segment is fully isolated from blast chamber 209 and gas expansion voids/baffles thereby eliminating issues that arise from carbon build up in ratcheting design suppressor QD's and screw on suppressor designs. In general, release button 205 reduces chances of accidental release of suppressor.

The QD also includes at least one locking lug 555 behind the at leastone machine rail receiver 215. Locking lug 555 is configured to rotate behind the at least one machine rail 115 when the at least one machine rail 115 is completely inserted into the at least one machine rail receiver 215, locking suppressor assembly 200 to barrel 100.

The quick release (e.g., release button 205) is mechanically coupled with the locking lug 555, the quick release is configured to rotate locking lug 555 out from behind the at least one machine rail 115 such that suppressor assembly 200 can be removed from barrel 100.

Referring now to FIG. 6, a front view of the muzzle 601 end of the firearms suppressor is shown in accordance with an embodiment. In one embodiment, expulsion ports 610 on front end 625 of suppressor assembly 200 are located from the 4 o'clock position around the top to the 8 o'clock position. In one embodiment, a plurality of upward angled expulsion ports 610 are located approximately between an 8 o'clock position around a top of the suppressor in a clockwise layout to approximately a 4 o'clock position. The angled vertical upward and forward facing runs allow for reduced felt recoil, reduced cyclic rate, reduced barrel rise, and reduced signature from decreasing or even eliminating downward exiting gasses disturbing soil under the muzzle end of the suppressor, reduced toxic, irritating gasses forced back into a shooters face.

Heat Shield

Figure 7:
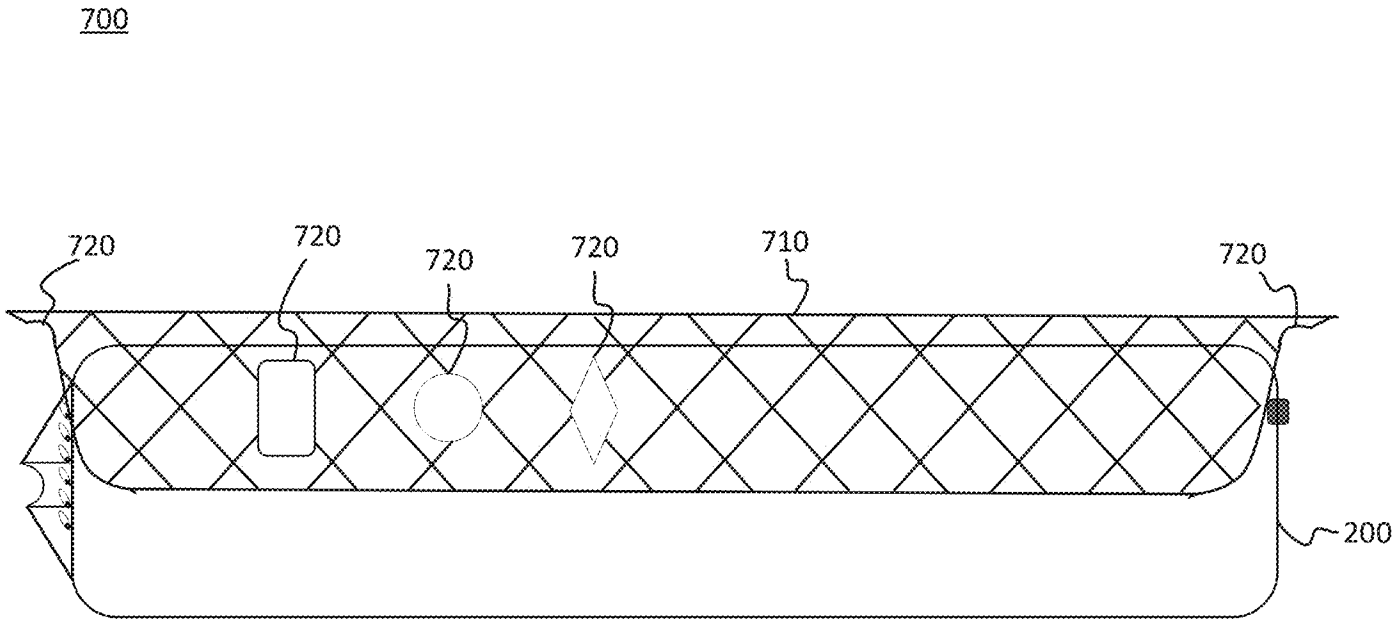
FIG. 7 is a side view of a heat shield covering a portion of the firearms suppressor, in accordance with an embodiment.

Referring now to FIG. 7, a side view of an optional heat shield 710 covering a portion of the firearms suppressor is shown in accordance with an embodiment. In general, optional heat shield 710 may be made out of any material that will help to dissipate heat from the side of suppressor assembly 200 instead of rising straight up directly above suppressor assembly 200. For example, by reducing the heat dissipating from directly above suppressor assembly 200, the associated heat mirage that could interfere with the image seen by sights or optics mounted on top of the firearm would be reduced. For example, if the sight or optic is mounted atop the firearm, then heat that radiates off of suppressor assembly 200 would provide a heat mirage. The heat mirage would change the sighting picture. By moving the heat mirage to the side instead of directly above suppressor assembly 200, the top mounted sights or optics would not be affected by the heat mirage. In one embodiment, optional heat shield 710 is made from a carbon fiber material or other heat resistant material.

In one embodiment, the optional heat shield 710 attaches to a top portion of the suppressor and extends over the rear and front of suppressor assembly 200. In one embodiment, the optional heat shield 710 attaches to a top portion of the suppressor and extends only over one of the rear or front of suppressor assembly 200. One embodiment further incorporates heat ports 720 to vector heat through rising path of least resistance to vent heat away to sides vice directly up in front of scope field of view. Although a number of different heat ports 720 configurations are shown, it should be appreciated that there may be none or any number of heat ports 720 and the heat ports may be of any number of different shapes and sizes. The number and shape of the few different heat port shapes shown in FIG. 7 is provided for purposes of clarity.

In one embodiment, expulsion ports 610 of FIG. 6 are used to vector the hot gasses into the heat shield 710 for dissipation and redirection to reduce mirage when the optional heat shield 710 is utilized.

The foregoing Description is not intended to be exhaustive or to limit the embodiments to the precise form described. Instead, example embodiments in this Description have been presented in order to enable persons of skill in the art to make and use embodiments of the described subject matter. Moreover, various embodiments have been described in various combinations. However, any two or more embodiments may be combined. Although some embodiments have been described in a language specific to structural features and/or methodological acts, it is to be understood that the subject matter defined in the appended claims is not necessarily limited to the specific features or acts described above. Rather, the specific features and acts described above are disclosed by way of illustration and as example forms of implementing the claims and their equivalents.

What is claimed is:

1. A suppressor comprising:

a blast chamber for receiving a bullet and a gas discharge from a fired round;

at least one toothed, machined rail receiver at a distal end of said suppressor, said at least one toothed, machined rail receiver to removably couple with at least one toothed, machined rail of a barrel when said suppressor is mounted on said barrel;

at least one suppressor muzzle brake port of said suppressor, said at least one suppressor muzzle brake port opening through a first internal wall of said suppressor, said at least one suppressor muzzle brake port to align with at least one barrel muzzle brake port when said suppressor is mounted on said barrel; and a longitudinal baffle of said suppressor, said longitudinal baffle having a multiple leg longitudinal run about an outermost periphery of said suppressor, said longitudinal baffle receiving a portion of the gas discharge from said at least one suppressor muzzle brake port and direct it toward a plurality of expulsion ports at a forward end of said suppressor, said longitudinal baffle comprises:

a first leg of a run configured to receive said gas discharge from said at least one suppressor muzzle brake port and direct it toward the forward end of said suppressor, said first leg having at least one opening therein for receiving the gas discharge from said at least one suppressor muzzle brake port;

a second leg of the run parallel to, but in an outer more position than said first leg, said second leg configured to receive the gas discharge from the first leg and direct it toward a back of said suppressor; and at least a third leg of the run parallel to, but in an outer more position than said second leg, said third leg configured to receive the gas discharge from the second leg and direct it toward said plurality of expulsion ports at the forward end of said suppressor.

2. The suppressor of claim 1, further comprising:

a wall thickness of said third leg is less than a wall thickness of said second leg; and the wall thickness of said second leg is less than a wall thickness of said first leg.

3. The suppressor of claim 2 wherein said third leg of the run further comprises a plurality of directional vanes from the group consisting of:

the plurality of directional vanes along an inner wall;

the plurality of directional vanes along an outer wall; and the plurality of directional vanes along both the inner wall and the outer wall.

4. The suppressor of claim 1, wherein the plurality of expulsion ports at the forward end of said suppressor are angled vertically upward and are located approximately between an 8 o'clock position, around a top of the suppressor, to approximately a 4 o'clock position.

5. The suppressor of claim 1, further comprising:

an indexed baffle stack arranged circumferentially about the blast chamber, a first two baffles of the indexed baffle stack being Inconel, the indexed baffle stack is removable or fixed based on different calibers.

6. The suppressor of claim 1, further comprising:

a locking lug behind said at least one toothed, machined rail receiver, said locking lug configured to rotate behind said at least one toothed, machined rail when said at least one toothed, machined rail is completely inserted into said at least one toothed, machined rail receiver, locking said suppressor to said barrel.

7. The suppressor of claim 6, further comprising:

a quick release mechanically coupled with said locking lug, said quick release configured to rotate said locking lug out from behind said at least one toothed, machined rail such that said suppressor can be removed from said barrel.

8. A suppressor comprising:

a blast chamber for receiving a bullet and a gas discharge from a fired round;

at least one toothed, machined rail receiver at a distal end of said suppressor, said at least one toothed, machined rail receiver to removably couple with at least one toothed, machined rail of a barrel when said suppressor is mounted on said barrel;

at least one suppressor muzzle brake port of said suppressor, said at least one suppressor muzzle brake port opening through a first internal wall of said suppressor, said at least one suppressor muzzle brake port to align with at least one barrel muzzle brake port when said suppressor is mounted on said barrel;

a longitudinal baffle of said suppressor, said longitudinal baffle having a multiple leg longitudinal run about an outermost periphery of said suppressor, said longitudinal baffle receiving a portion of the gas discharge from said at least one suppressor muzzle brake port and direct it toward a plurality of expulsion ports at a forward end of said suppressor, said longitudinal baffle comprising:

a first leg of a run configured to receive said gas discharge from said at least one suppressor muzzle brake port and direct it toward the forward end of said suppressor, said first leg having at least one opening therein for receiving the gas discharge from said at least one suppressor muzzle brake port;

a second leg of the run parallel to, but in an outer more position than said first leg, said second leg configured to receive the gas discharge from the first leg of said suppressor and direct it toward a back of said suppressor; and at least a third leg of the run in a more outer position than said second leg, said third leg configured to receive the gas discharge from the second leg and direct it toward said plurality of expulsion ports at the forward end of said suppressor.

9. The suppressor of claim 8, further comprising:

a wall thickness of said third leg is less than a wall thickness of said second leg; and the wall thickness of said second leg is less than a wall thickness of said first leg.

10. The suppressor of claim 9 wherein said third leg of the run further comprises a plurality of directional vanes from the group consisting of:

the plurality of directional vanes along an inner wall;

the plurality of directional vanes along an outer wall; and the plurality of directional vanes along both the inner wall and the outer wall.

11. The suppressor of claim 8, wherein the plurality of expulsion ports at the forward end of said suppressor are angled vertically upward and are located between approximately an 8 o'clock position, about a top of the suppressor, to approximately a 4 o'clock position.

12. The suppressor of claim 8, further comprising:

an indexed baffle stack arranged circumferentially about the blast chamber, a first two baffles of the indexed baffle stack being Inconel, the indexed baffle stack is removable or fixed based on different calibers.

13. The suppressor of claim 8, further comprising:

a locking lug behind said at least one toothed, machined rail receiver, said locking lug configured to rotate behind said at least one toothed, machined rail when said at least one toothed, machined rail is completely inserted into said at least one toothed, machined rail receiver, locking said suppressor to said barrel; and a quick release mechanically coupled with said locking lug, said quick release configured to rotate said locking lug out from behind said at least one toothed, machined rail such that said suppressor can be removed from said barrel.

14. A suppressor comprising:

a blast chamber for receiving a bullet and a gas discharge from a fired round;

an indexed baffle stack arranged circumferentially about the blast chamber, a first two baffles of the indexed baffle stack being Inconel, the indexed baffle stack is removable or fixed based on different calibers;

at least one toothed, machined rail receiver at a distal end of said suppressor, said at least one toothed, machined rail receiver to removably couple with at least one toothed, machined rail of a barrel when said suppressor is mounted on said barrel;

a locking lug behind said at least one toothed, machined rail receiver, said locking lug configured to rotate behind said at least one toothed, machined rail when said at least one toothed, machined rail is completely inserted into said at least one toothed, machined rail receiver, locking said suppressor to said barrel;

a quick release mechanically coupled with said locking lug, said quick release configured to rotate said locking lug out from behind said at least one toothed, machined rail such that said suppressor can be removed from said barrel;

at least one suppressor muzzle brake port of said suppressor, said at least one suppressor muzzle brake port opening through a first internal wall of said suppressor, said at least one suppressor muzzle brake port to align with at least one integrated barrel muzzle brake port when said suppressor is mounted on said barrel; and a longitudinal baffle of said suppressor, said longitudinal baffle having a multiple leg longitudinal run about an outermost periphery of said suppressor, said longitudinal baffle receiving a portion of the gas discharge from said at least one suppressor muzzle brake port and direct it toward a plurality of expulsion ports at a forward end of said suppressor.

15. The suppressor of claim 14, wherein said longitudinal baffle comprises:

a first leg of a run configured to receive said gas discharge from said at least one suppressor muzzle brake port and direct it toward the forward end of said suppressor, said first leg having at least one opening therein for receiving the gas discharge from said at least one suppressor muzzle brake port;

a second leg of the run parallel to, but in an outer more position than said first leg, said second leg configured to receive the gas discharge from the first leg at the forward end of said suppressor and direct it toward a back of said suppressor; and at least a third leg of the run parallel to, but in an outer more position than said second leg, said third leg configured to receive the gas discharge from the second leg at a rear of said suppressor and direct it toward said plurality of expulsion ports at the forward end of said suppressor.

16. The suppressor of claim 15, further comprising:

a wall thickness of said third leg is less than a wall thickness of said second leg; and the wall thickness of said second leg is less than a wall thickness of said first leg.

17. The suppressor of claim 16 wherein said third leg of the run further comprises a plurality of directional vanes from the group consisting of:

the plurality of directional vanes along an inner wall;

the plurality of directional vanes along an outer wall; and the plurality of directional vanes along both the inner wall and the outer wall.

18. The suppressor of claim 14, wherein the plurality of expulsion ports at the forward end of said suppressor are angled vertically upward and are located between approximately an 8 o'clock position, about a top of the suppressor, to approximately a 4 o'clock position.

* * * * *